United States Patent [19]

Cobelli

[11] 3,976,233

[45] Aug. 24, 1976

[54] WRIST-WATCH BRACELET

[75] Inventor: Mario Cobelli, Milan, Italy

[73] Assignee: Multibrev Anstalt, Vaduz, Liechtenstein

[22] Filed: June 27, 1975

[21] Appl. No.: 590,963

[30] Foreign Application Priority Data

July 12, 1974 Italy ..... 25157/74
July 19, 1974 Italy ..... 25371/74

[52] U.S. Cl. ..... 224/4 E; 24/265 B; 24/265 WS; 59/80; 59/91; 224/4 H

[51] Int. Cl.[2] ..... F16G 13/18

[58] Field of Search ..... 59/80, 82, 78, 90, 91, 59/35; 63/4; 224/4 B, 4 D, 4 E, 4 H; 24/265 B, 265 WS, 241 WB

[56] References Cited

UNITED STATES PATENTS

| | | | |
|---|---|---|---|
| 2,246,221 | 6/1941 | Prestinari | 59/80 |
| 2,505,169 | 4/1950 | Bikoff | 59/80 |
| 2,531,053 | 11/1950 | Kehrer | 24/265 WS |
| 3,118,209 | 1/1964 | Vollet | 24/265 B |
| 3,453,821 | 7/1969 | Kian | 59/79 B |
| 3,880,014 | 4/1975 | Bendall | 59/78 |

*Primary Examiner*—Lowell A. Larson
*Assistant Examiner*—Gene P. Crosby

[57] ABSTRACT

Bracelet, particularly for wrist-watches, comprising a plurality of interarticulated links, provided with means for connection to the wrist-watch body or case, wherein each of the links can be formed from a plate sheet, and wherein each of the links comprise a hollow body having at two opposite ends extensions which are rolled up according to at least a spiral length, the bendings of which are such that one extension of a link can be axially inserted in the extension of the adjoining link.

10 Claims, 13 Drawing Figures

WRIST-WATCH BRACELET

Wrist-watch bracelets are known of the type wherein the several links are articulated to one another to form a chain, and are provided with wrist-watch hooking means and a clip for closing the bracelet around the wrist, said bracelet generally comprising two parts.

Due to inextensibility in bracelets of this type, the length thereof should be varied for accomodation to various wrist circumferences, and this is ordinarily accomplished by the dealer, since such an operation would usually require the use of special implements and good manual dexterity or skill.

Finally, when assembling the bracelet on the wrist-watch, the problem arises that the connection width is never the same for all watches, it being therefore necessary to provide end connections of various widths, or more frequently to provide bracelets of various widths.

Moreover, the prior art bracelets are rather complex and expensive to make, and when made from sheared, stamped or curved plate, as it would be preferable in order to obtain low cost products, such bracelets suffer from additional disadvantages.

For instance, U.S. Pat. No. 2,537,789 discloses a bracelet wherein the articulation or linkage is provided by a link tang inserting in the recess or cavity in the adjoining link. Irrespective of assembling difficulty, when the bracelet is finished, it would be no longer possible to remove links by simple means within any user's reach.

The bracelet disclosed in the British Pat. No. 1,112,325 can be more readily disassembled, but entails the provision of double connection pins between two adjoining links, thereby resulting in a very high cost, and also not enabling it to be made from sheet material.

Then, the connection means for the bracelet to the wrist-watch are always complicated, of a constant width and are quite unsuitable for hooking and unhooking operations from the user. For example, the connection means disclosed in the British Patent No. 351,778 and in U.S. Pat. Specification No. 1,619,014 are grounded on elastic deformability of a plate, and when considering the small dimensions of such connection means, the necessary force for deformation thereof will require the use of particular implements, and prevents the ready interchangeability of the bracelets.

The present invention aims to provide a bracelet, particularly a wrist-watch bracelet, wherein said disadvantages are removed, that is a bracelet, the links of which can be obtained from stamped and/or curved plates, wherein the linkage between one and another link will not require any pivots, pins or the like, having a reliable connection which, however, can be readily disassembled and assembled from the user without any particular implements, and additionally having wrist-watch connecting means with the same characteristics as above referred to, and which can also be accomodated to the various wrist-watch widths.

In order to accomplish the above mentioned objects, a bracelet is provided, particularly a wrist-watch bracelet, comprising a plurality of links articulated to one another, fitted with means for connection to the wrist-watch body or case, wherein each of the elements can be made from a plate sheet, characterized in that each of the links comprise a hollow body having at two opposite ends edges which are rolled up according at least to a spiral section, the bendings of which being such that an edge of a link can be axially introduced into the edge of the adjacent link.

Furthermore, the end links are advantageously provided with means for connection to the wrist-watch body or case, such means comprising an edge extending from the link body and rolled up according to an open cylinder, the latter not necessarily being of circle arc cross-section, the arc length for the various sections decreasing from one to the other end of the cylinder.

These and other features will become more evident from the following detailed description given by mere way of unrestrictive example, reference being had to the accompanying drawings in which.

Figure 5:
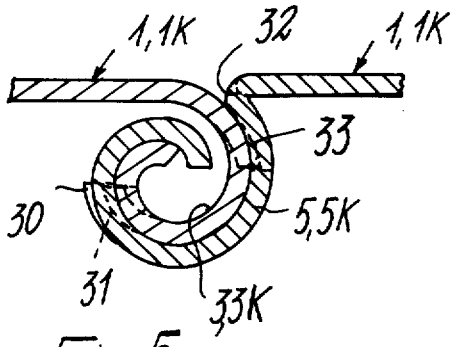
Figure 6:
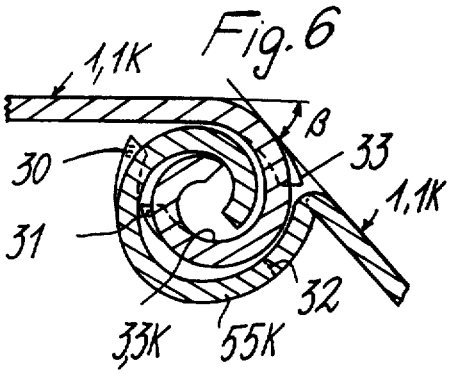
Figure 7:
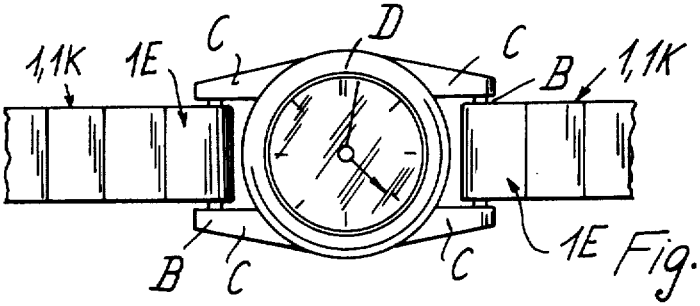
Figure 8:
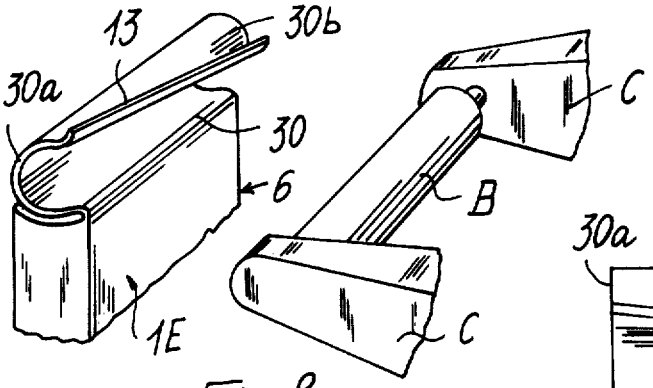
Figure 9:
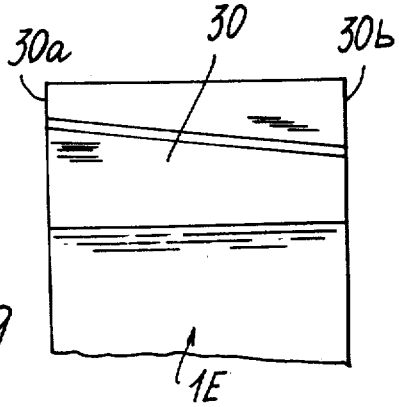
Figure 10:
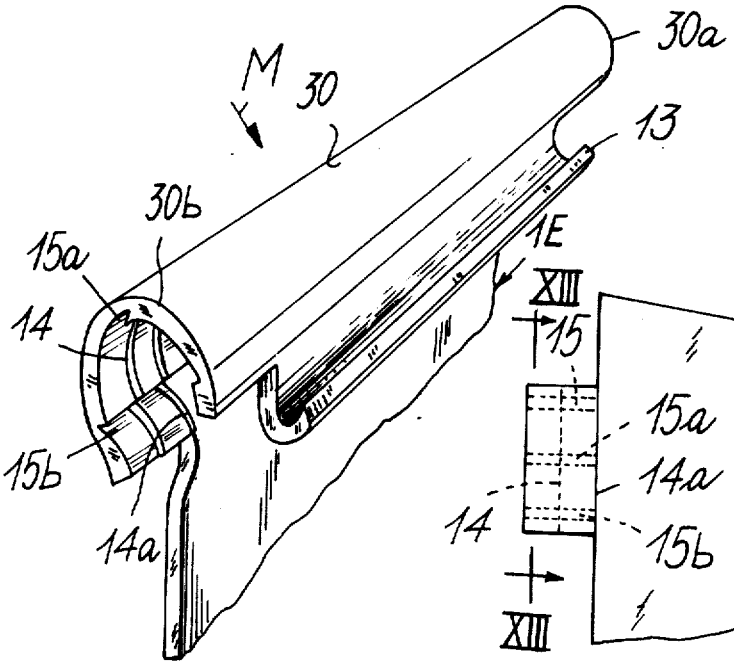
Figure 11:
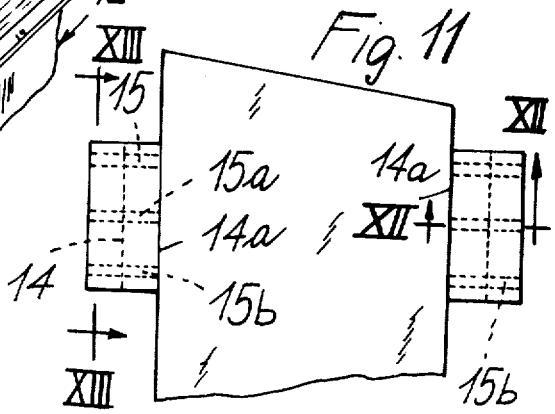
Figure 12:
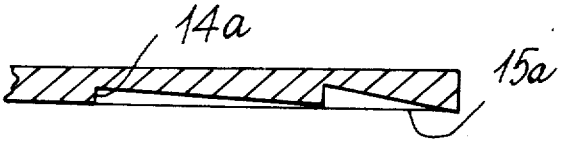
Figure 13:
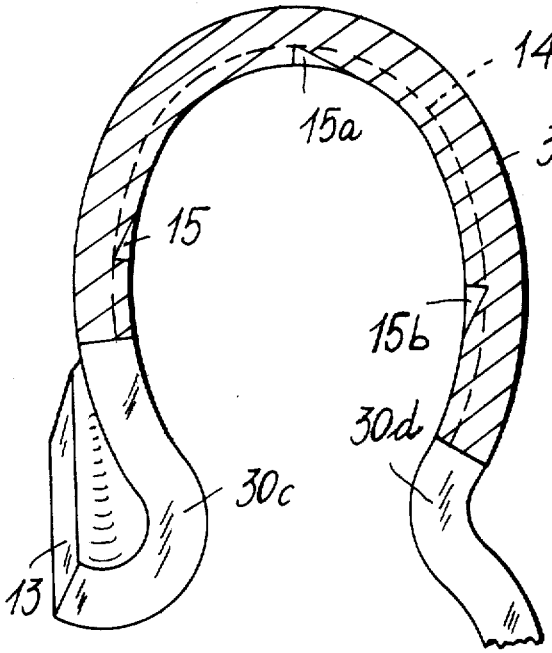

FIGS. 5 and 6 schematically show only the helically rolled up parts of two adjoining links, said parts being interconnected respectively at a rest position and at a ready-to unhooking or disconnecting position, provided with cooperating ridges and depressions for inhibiting at normal use positions any link disengagement in opposite direction to engagement direction;

FIG. 7 is a front view showing a wrist-watch provided with a bracelet according to the invention;

FIG. 8 is a perspective view on a different scale showing a first embodiment for the bracelet connection to the wrist-watch and laterally showing a fork provided with a known type of pin for wrist-watches;

FIG. 9 is a view in the direction of arrow G for the connection shown in FIG. 8;

FIG. 10 shows another embodiment for a widened connection, provided with weakening indentations and cutouts for adapting it to the various sizes of watches;

FIG. 11 is a plane view for the connection of FIG. 10 as seen from the outside (arrow M);

FIG. 12 is a substantially enlarged sectional view taken along line XII—XII, showing a portion of FIG. 11, the other portion of which being fully symmetrical; and FIG. 13 is an enlarged sectional view taken along line XIII—XIII of FIG. 10, particularly showing the preferred elongated form for the eyelet and the provision of two opposite loops.

Figure 1:
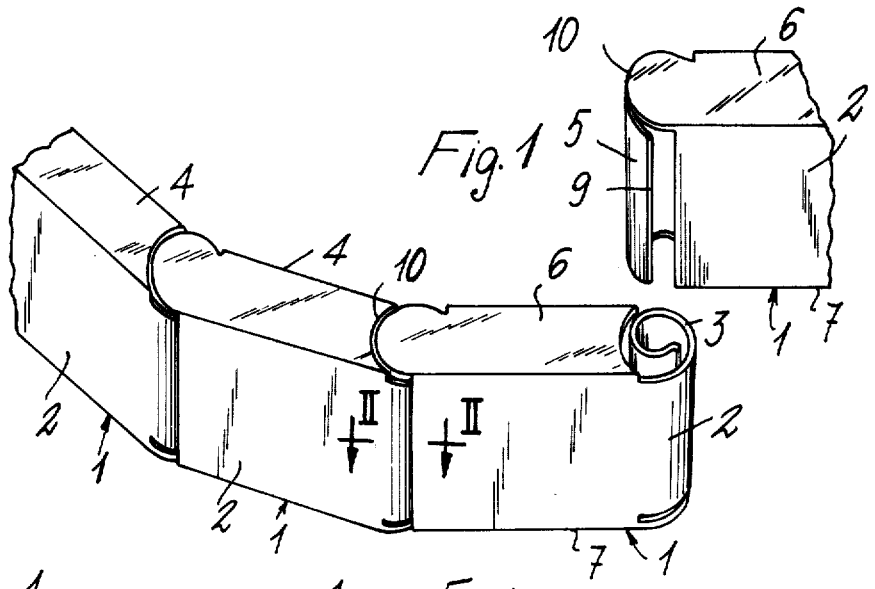
FIG. 1 is a perspective view schematically showing some links of a bracelet according to the invention, one of the links being at disengaged or disconnected position.
Figure 2:
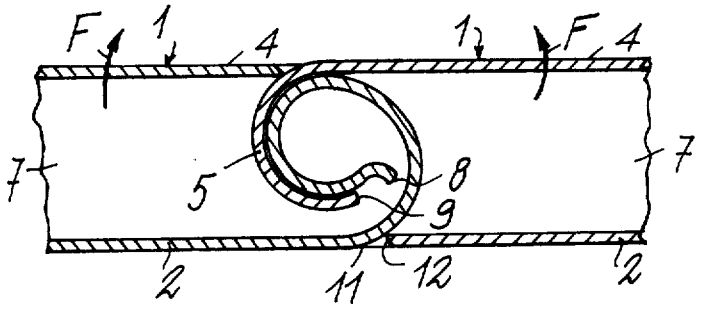
FIG. 2 is a longitudinal cross-section of FIG. 1, taken along already connected parts and substantially corresponding to line II—II of FIG. 1.

Referring to FIGS. 1 and 2, a bracelet according to the invention comprises a series of links, designated as a whole at 1, and interconnected so as to a sufficient relative angular movement or displacement in the direction F for adapting it to persons' wrist. In the embodiment shown, each of the links comprise a substantially tubular body 1, having a rectangular-like cross-section with a wall 2 extending with a substantially spiral-like extension 3 terminating in a hook at 8, which hook can be replaced by a swelling or enlargement. The opposite wall also extends with a substantially spiral-like extension 5 having a less development or lenght than the former, but a larger (varying) radius so that, as shown in FIG. 2, this extension 5 will engage or contain said extension 3 when the ends of two adjoining links are laterally inserted, as shown in FIG. 1. The first of the two remaining walls, designated at 6 and 7, extends at one end above extension 5, whereas the second of said walls extends above extension 3. The contour of is curvilinear, particularly according to an arc of circle, and such a contour is substantially conjugated at the concavity 10 at the other end of walls 6 and 7. The extensions of these walls are for limiting the engagement stroke of extensions 3 and 5.

The rotation of two adjoining links in the directions of arrows F is restricted by the engagement of end edge 9 of extension 5 with the hook-like end 8 of extension 3 of the adjoining connected link. The rotation in directions opposite to those of arrow F is on the other hand restricted by the engagement of the transiction zone 11 between wall 2 and extension 3 of a link and the edge 12 of wall 2 of the next link.

Figure 3:
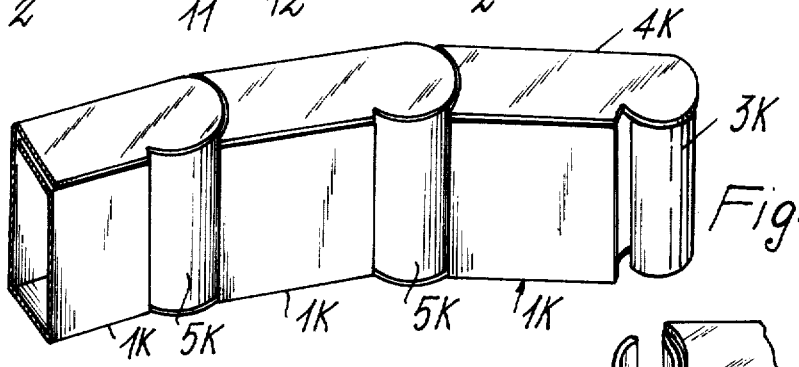
FIG. 3 is a rear modified view similar to FIG. 1, particularly suitable for being provided from metal sheet bands.
Figure 4:
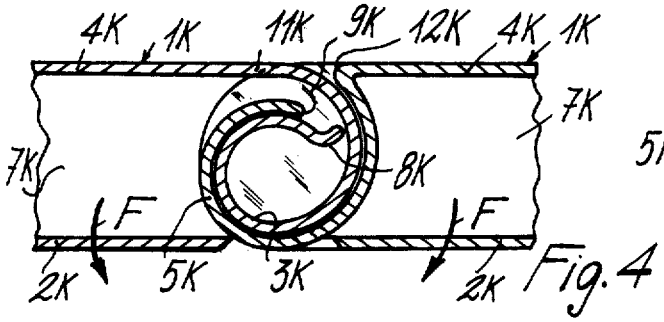
FIG. 4 is a longitudinal sectional view of FIG. 3 corresponding to FIG. 2.
Figure 4:
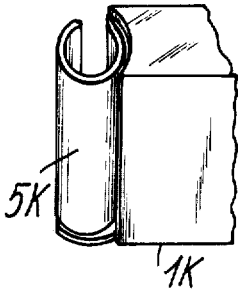

The embodiment shown in FIGS. 3 and 4 differs from that previously described in that the spiral-like extensions for each of the links are provided at the ends of the same wall. Due to equivalence of this embodiment, to designate like or corresponding parts the same reference numerals have been herein used, but followed by letter "*k*".

Extensions 3, 5; 3*k*, 5*k* for each line 1, 1*k* entail suitable means for preventing unthreading of the links, such as ridges and notches, or more simply circumferential ribs wherein the tip, as formed for example on the inner extension 3, 3*k*, penetrates into the corresponding cavity of the outer extension 5, 5*k*.

On mutual rotation of two adjoining links 1, 1*k* beyond a given length, will cause the spiral-like surfaces, which are normally contacting one another, to move away for the most distance, and this due to the spiral configuration of the connecting links 3, 5; 3*k*, 5*k*, as shown in FIGS. 5 and 6. This peculiarity is exploited to assure that the engaged links cannot unthread until the angle therebetween exceeds a determined value, larger than the links can form when the braceled is closed on itself, or in other terms, when the bracelet is closed on the wrist. Extension 5, 5*k* is provided with a slot 32 and an outwardly bent lip or tab 30. Extension 3, 3*k* is provided with two spaced apart, outwardly bent tabs 31 and 33, respectively located at the level of said slot 32 and tab 30 and having substantially the same length. Extensions 5, 5*k*, 3, 3*k* are mutually engaged when the two links 1, 1*k* form an angle $\beta$ which is about the same as or larger than that shown in FIG. 6. When angle $\beta$ reaches such a value that tabs 31 and 33 respectively engage within the free-left room of tab 30 and within slot 32, the disengagement or disconnection is prevented (see for example FIG. 5).

Particularly referring now to FIGS. 7–13, the end links 1E of a bracelet according to the invention will be described in relation to the connection thereof to a wrist-watch D.

Instead of having the above described spiral-like extension, said links 1E have at the free end thereof an inwardly bent or curved loop 30, for example but not necessarily according to an arc of circle with a bending radius substantially equal to that of pin B which, as well known, is positioned transversely of the bilateral forks C of the wrist-watch D.

This loop 30 is designed to be snap-engaged on said wrist-watch pin B and in order to facilitate such an operation the initial (or final) portion 30*a* of the loop has a perimetral extension which is less than the final (or initial) portion 30*b* of the loop, so that the engagement on pin B (or vice versa) is gradually and smoothly effected, the end rim 13 of loop 30 being sufficiently outwardly bent.

As shown in FIG. 13, loop 12 can have in a preferred modification a non circular right section, but slightly elongated, and two inwardly projecting zones facing each other, designated at 30*c* and 30*d*, forming a neck portion for the loop 30, that said pin B has to pass over in order to be accomodated within said loop.

This particular configuration for the loop will allow for even repetitevely connect and disconnect the wrist-watch bracelet in a very easy and ready manner, while maintaining the same stability as exhibited by conventional connections.

In order to accomodate the connection to several sizes of wrist-watches, provision can be made (see FIGS. 10–13) for a loop 30 having a series of inner indentations or longitudinal and transverse weakening zones 14, 14*a* and 15, 15*a* respectively.

By manually or mechanically exerting an outward tension on these indentations, the connection will be correspondingly shortened, tearingly removing along such weakening zones those connection sections which exceed the wrist-watch size. Since the connection shearing along the end indentations 14 is more frequent with respect to the furthermost indentations 14*a*, the invention contemplates for the former a more accentuated lightening depth, so that along these indetations 14 the connection can be accomodated more easily with respect to the retracted ones, designated by 14*a* on the drawings. For the sake of clearity, FIG. 12 shows on a much enlarged scale over the other figures of the drawings a constructive approach for this inventive peculiarity. In this figure, it will be seen that angle $\alpha$ as formed by the indentation sides takes different values $\alpha_1$ and $\alpha_2$.

However, it is evident the shape of the indentations may vary according to instances and requirements, without departing for this from the scope of the present invention.

Preferably, the links are made from lamination sheet.

What I claim is:

1. A bracelet, particularly for wrist-watches, comprising a plurality of interarticulated links, provided with means for connection to the wrist-watch body or case, wherein each of the links can be formed by a plate sheet, and wherein each of the links comprise a hollow body having at two opposite ends extensions which are rolled up according to at least a spiral length, the bendings of which are such that one extension of a link can be axially inserted in the extension of the adjoining link.

2. A bracelet as claimed in claim 1, wherein one side of the hollow body extends over the extension at only one end thereof in a plane perpendicular to the spiral axis.

3. A bracelet as claimed in claim 1, wherein at least one of the extensions of each link has means for stopping the rotation of said link relative to the adjoining link.

4. A bracelet as claimed in claim 3, wherein said means for stopping consist of a bent-over edge of the innermost extension end.

5. A bracelet as claimed in claim 1, wherein each of the extensions have retaining means against axial slide or slippage.

6. A bracelet as claimed in claim 5, wherein said retaining means consist of conjugated ridges or ribs formed on the extensions of each link.

7. A bracelet, particularly for wrist-watches, comprising a plurality of interarticulated links, wherein the end links have means for connection to the wrist-watch body or case, such means comprising an edge extending from the link body which is rolled up according to an open cylinder, the latter not necessarily being of circle arc cross-section, the arc lengths for the various right sections decreasing from one to the other end of the cylinder.

8. A bracelet as claimed in claim 7, wherein said open cylinder is of elongated cross-section having two opposite loops forming a neck portion.

9. A bracelet as claimed in claim 7, wherein the end links have a widened zone provided with weakening indentations circumferentially and axially of the open cylinder axis.

10. A bracelet as claimed in claim 9, wherein the depth of said indentations is decreasing from the outermost to the innermost indentation.

* * * * *